US005672559A

United States Patent [19]

Watanabe et al.

[11] Patent Number: 5,672,559

[45] Date of Patent: Sep. 30, 1997

[54] REVERSIBLE THERMAL RECORDING MEDIUM AND METHOD OF PRODUCING THE SAME

[75] Inventors: Niro Watanabe, Kitasaitama-gun; Yuji Nakatsu, Kitakatsushika-gun; Keiki Yamada; Masaru Ohnishi, both of Kamakura, all of Japan

[73] Assignees: Toppan Printing Co., Ltd., Taito-ku; Mitsubishi Denki Kabushiki Kaisha, Tokyo, both of Japan

[21] Appl. No.: 531,865

[22] Filed: Sep. 21, 1995

Related U.S. Application Data

[62] Division of Ser. No. 462,199, Jun. 5, 1995, which is a division of Ser. No. 201,067, Feb. 24, 1994, which is a continuation of Ser. No. 883,152, May 14, 1992, abandoned.

[30] Foreign Application Priority Data

May 23, 1991 [JP] Japan ..... 3-118310

[51] Int. Cl.[6] ..... B41M 5/34

[52] U.S. Cl. ..... 503/201; 503/204; 503/215; 503/226

[58] Field of Search ..... 503/201, 204, 503/215, 226; 427/152

[56] References Cited

U.S. PATENT DOCUMENTS

| | | | |
|---|---|---|---|
| 4,425,161 | 1/1984 | Shibahashi et al. | 106/21 |
| 4,554,565 | 11/1985 | Kito et al. | 503/201 |
| 4,598,035 | 7/1986 | Usami et al. | 430/138 |

*Primary Examiner*—Bruce H. Hess
*Attorney, Agent, or Firm*—Wolf, Greenfield & Sacks, P.C.

[57] ABSTRACT

A reversible thermal recording medium having a core material capable of being change in state by heat and a recording layer including capsules containing this core material. A repeatability corresponding to the limit of possible repeated recording/erasing effected by a physical or chemical change in the material constituting the recording can be obtained. A deterioration in image quality caused by transfer of a part of the recording layer to the heating unit can be prevented and repeat characteristics can be improved, thereby limiting the running cost.

11 Claims, 4 Drawing Sheets

REVERSIBLE THERMAL RECORDING MEDIUM AND METHOD OF PRODUCING THE SAME

This application is a division of application Ser. No. 08/462,199, filed Jun. 5, 1995, entitled REVERSIBLE THERMAL RECORDING MEDIUM AND METHOD OF PRODUCING THE SAME and now pending, which in turn is a division of Ser. No. 08/201,067 filed Feb. 24, 1994, now pending, which is a File Wrapper Continuation of Ser. No. 07/883,152 filed May 14, 1992, now abandoned.

BACKGROUND OF THE INVENTION

1. Field of the Invention

This invention relates to a reversible thermal recording medium on which an image is recorded or erased by utilizing a reversible change in a recording layer caused by a change in temperature and to a method of producing this medium.

2. Description of the Related Art

Recently, the development of reversible thermal recording mediums capable of recording or erasing an image with heat have been promoted. Reversible thermal recording mediums heretofore known include one based on using a physical change, i.e., an organic low-molecular type (e.g., the one disclosed in Japanese Patent Laid-Open Publication No. S55-154198) in which transition between a slightly-opaque state and a transparent state can be reversibly repeated with a change in heating temperature and in which one of these states can be maintained with stability at a temperature lower than a certain point, and one based on utilizing a chemical change, i.e., a lueco dyestuff type (e.g., the one disclosed in Japanese Patent Laid-Open Publication No. H2-188294) which consists of a mixture of a lueco dyestuff and a color developing/subtracting agent, in which an organic material having both hydroxyl and carboxyl in a molecule and having a property such as to reversibly release hydrogen ions is used as a color developing/subtracting agent, and which is capable of developing a color at a high temperature and removing color by heating at a lower temperature.

More specifically, the former is constituted of a matrix material formed of a thermoplastic resin or the like and an organic low-molecular material dispersed in the matrix material and has a property such as to be changed in state according to a temperature which is higher than a particular temperature T0 and at which it is maintained. That is, it has a recording layer having two state transition temperatures T1 and T2 (T1<T2) higher than T0. If the recording layer is heated to and maintained at a temperature higher than T2 and is thereafter cooled to a temperature lower than T0, it becomes slightly opaque, i.e., comes into a maximum shading state. If the recording layer in this slightly-opaque state is heated to and maintained at a temperature equal to or higher than T1 and smaller than T2 and is thereafter cooled to a temperature lower than T0, it becomes transparent. These changes of state are mainly based on changes in the organic low-molecular material in the recording layer.

The latter recording medium can be changed into an organic compound by thermal energy control alone, i.e., by opening the lactone ring by high-temperature heating and can be returned to a colorless lueco compound by closing the lactone ring by low-temperature heating. This phenomenon is based on the structure of the color developing/subtracting agent and the reversibility of the lueco dyestuff, and can repeatedly be effected. A salt of gallic acid and fatty acid amine or the like is known as such a color developing/subtracting agent.

To increase the number of change repeating times of such reversible thermal recording mediums, a method of forming a transparent protective layer on the former type of medium (as disclosed in Japanese Patent Laid-Open Publication Nos. S57-82086, H2-131984, H2-81672 and H2-566) and a method of forming a thermoplastic resin protective layer on the latter type of medium have been practiced.

On the other hand, methods disclosed in U.S. Pat. No. 2,712,507, Japanese Patent Publication No. S51-35414, Japanese Patent Laid Open Nos. S58-211488, S59-229392, S60-214990 and H2-81679 are known as methods utilizing encapsulation, which is also utilized in accordance with the present invention. Almost all of these methods use a type of lueco dyestuff with which a color development reaction is started by breaking a capsule or a reaction is caused by permeation through a capsule wall, and are intended to improve the keeping quality of a thermosensible sheet.

With respect to use of a heating unit such as a thermal head, improvements in the conventional reversible thermal recording mediums are considered as only mitigation of the problem of transfer of a part of the recording layer to the heating unit or a change in the surface configuration of the recording layer in comparison with an arrangement in which an image is recorded and erased directly on a thermosensible medium (without a protective layer). That is, according to experiments made by the inventors of the present application, even if a protective layer formed of a thermoplastic resin or the like is used, the number of repeating times cannot be increased to 50 and there is the problem of a reduction in image quality due to transfer of the material of the protective layer or the recording layer to the heating unit (attachment of dust scraped off). This is because a recording mark is left by the heat and pressure of the thermal head, i.e., the heating unit so that the surface of the recording layer is roughened and the desired surface flatness is lost. Even if the heat resistance of the protective layer is improved by using a thermosetting type of UV setting type resin, the number of repeating times is at most 100, and a number of repeating times of 1,000 to 10,000, which is a limit of an essential physical or chemical change, cannot be obtained.

SUMMARY OF THE INVENTION

The present invention has been achieved to solve the above-described problems, and an object of the present invention is to provide a reversible thermal recording medium having a repeatability corresponding to the limit of possible repeated recording/erasing effected by a physical or chemical change in a material constituting the recording the recording layer.

Another object of the present invention is to provide a reversible thermal recording medium capable of recording a high-contrast image.

Still another object of the present invention is to provide a method of producing such reversible thermal recording mediums.

To achieve these objects, according to one aspect of the present invention, there is provided a reversible thermal recording medium capable of repeating recording and erasing of states by heat, the recording medium comprising a core material capable of being changed in state by heat, and a recording layer including a capsule containing the core material.

According to another aspect of the present invention, there is provided a method of producing a reversible thermal recording medium, the method comprising preparing a core material capable of being reversibly changed in state by heat, forming capsules containing the core material, and forming a recording layer of the formed capsules.

In accordance with the present invention, a recording layer including capsules containing the core material is provided. Precipitation of the core material can therefore be prevented, so that there is no possibility of a part of the recording layer transferring to a heating unit. The core material is encapsulated so that it can be independently changed in state in each capsule. Because this change in state is shielded in the capsules, the performance of the core material is not reduced even if the recording layer is brought into contact with an extraneous reactive material; the state of the core material is very stable. The capsules serve to eliminate the influence of oxidation and to prevent the recording layer from being damaged by heating. The problem of a reduction in image quality is thereby solved and repeat characteristics can be remarkably improved.

Also, at least one constituent of the core material may also be provided outside and around the capsules to obtain a high-contrast image. Also, a protective layer is provided on one or both surfaces of the recording layer to prevent precipitation of the core material more completely and to prevent it from being transferred to the heating unit.

The core material capable of being reversibly changed in state by heat is selected in the selection step and the capsules for containing the selected core material are formed by the capsule formation step, thereby providing an environment in which the core material can be independently changed in state in each capsule. The recording layer formation step is effected after the formation of the capsules, so that the adhesion with the capsules and the protective layer can be improved.

DESCRIPTION OF THE PREFERRED EMBODIMENTS

Figure 1A:
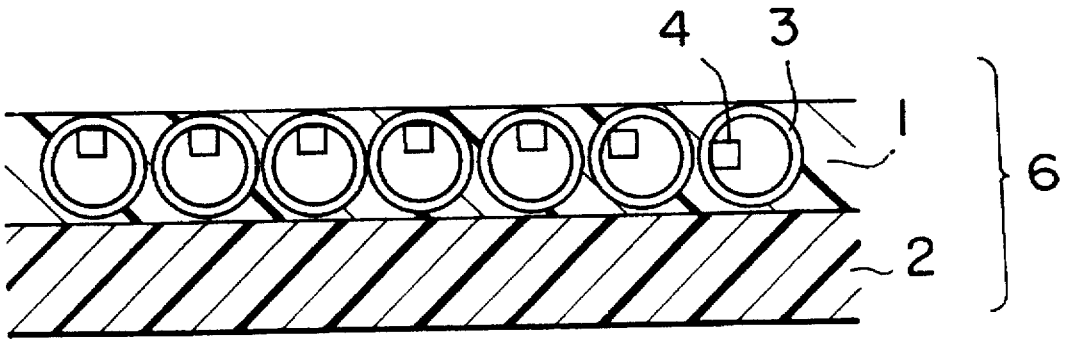
FIG. 1A is a schematic cross-sectional view of an organic low-molecular type reversible recording medium in accordance with an embodiment of the present invention.

Preferred embodiments of the present invention will be described below with reference to the accompanying drawings. FIG. 1A is a schematic cross-sectional view of a reversible thermal recording medium in accordance with the first embodiment of the present invention. As shown in FIG. 1A, a reversible thermal recording medium 6 is formed of a recording layer 1 and a support member 2. The recording layer 1 includes capsules 3 and an organic low-molecular material 4. That is, in the reversible thermal recording medium 6 in accordance with the first embodiment, the recording layer 1 which is capable of being reversibly changed in state depending upon the temperature and which includes capsules 3 containing organic low-molecular material 4 as a main constituent is formed on the support 2 formed of a transparent or opaque sheet, e.g., paper, glass, PET film or a metallic plate (light reflecting layer). If the recording layer has sufficiently high mechanical stability or if the recording layer 1 has an increased thickness such as to be capable of maintaining its shape by itself, the reversible thermal recording medium 1 can be formed without support member 2.

The organic low-molecular material 4 used in the recording layer 1 is preferably a material having a melting point or a setting point of about 300° C., i.e., a compound containing at least one of oxygen, nitrogen, sulfer and halogen in a molecule, more specifically, higher fatty acid, such as stearic acid, arachic acid or behenic acid, or a higher fatty acid ester.

The principle of the thermal reversibility in accordance with the present invention is such that the material becomes slightly opaque when cooled at room temperature after being heated at a high temperature and becomes transparent when cooled at room temperature after being heated at a low temperature. This is considered due to the crystalline state of organic low-molecular material. That is, it is supposed that in the case of high-temperature heating the organic low-molecular material is melted and cooled so as to be crystallized into polycrystals which scatter incident light and render the material slightly opaque, while in the case of low-temperature heating the organic low-molecular material comes into a half-melted state and is solidified while being crystallized into a monocrystal to be set in a transparent state such that incident light is transmitted through or reflected by the support member without being scattered.

The inventors made non-contact experiments, for example, based on repeating a process of putting a recording layer in a high-temperature chamber (at 100° C.), cooling the recording layer at room temperature to set it-in a slightly-opaque state, then putting the recording layer in a low-temperature chamber (at 80° C.) and making the recording layer transparent by cooling at room temperature. It was thereby confirmed that recording and erasing based on the above principle could be repeated at least 10,000 times. A recording layer was also formed by a well-known recording layer forming method; a resin and an organic low-molecular material were dissolved in a solvent and dried to form a recording medium in which the organic low-molecular material was dispersed in the resin. This recording layer was heated with a heating unit such as a thermal head. As a result, irregularities were caused in the recording layer surface, dust scraped off was attached to the heating unit, and the resin and the organic low-molecular material were oxidized so that the above-described characteristics were lost. The surface was worn such as to reflect light in a diffused reflection manner. As the number of repeating times was further increased, the friction with the heating unit was increased so that recording could not be performed.

A method of solving these problems by providing a protective layer formed of an inorganic material, such as $Al_2O_3$, a silicone resin or polyester resin over the recording layer by a sputtering method or a vacuum deposition method was also tested. However, the number of practically effective repeating times achieved by this method was at most about 50.

In a case where a protective layer was provided on the recording layer, a problem of a part of the protective layer separating and attaching to the thermal head was also encountered. This may be because the recording layer formed of the resin and the organic low-molecular material is melted or half melted at the time of heating (high-temperature heating and low-temperature heating) so that the adhesion between the recording layer and the protective layer is deteriorated, and they are separated and irregularities are formed in the surface. It is thought that an improvement in the adhesion between the protective layer and the recording layer is necessary for preventing this phenomenon.

The inventors have further studied to find that an excellent and effective recording layer can be obtained by encapsulating a core material in the recording layer, thereby achieving the present invention.

That is, the first embodiment of the present invention is characterized in that at least organic low-molecular material 4 is enclosed in capsules 3 to form a recording layer. It is thereby possible to prevent precipitation of the core material. Encapsulating the core material is specifically advantageous in enabling the core material to be independently changed in state in each capsule. Also, since the core material is protected by the capsules, the performance of the core material is not reduced by the protection of the capsules even if the recording layer is brought into contact with an extraneous reactive material. The range of application can therefore be extended. The above-described influence of oxidation can also be eliminated and the recording layer can be prevented from being damaged by heating.

Encapsulating methods have been disclosed in the above-mentioned patent publications and are well known by those skilled in the art. However, no example of encapsulation of a reversible recording material is known. That is, according to the present invention, a novel construction is provided in which a reversible recording material is encapsulated. Conventional encapsulation methods can be used to encapsulate the reversible recording material in accordance with the present invention. Examples of such encapsulation methods are a complex coacervation method, an in situ method, an interfacial polymerization method, a spray drying method, an in-liquid setting coating method, a method of phase separation from a water solution system, a method of phase separation from an organic solution system, and a melt dispersion cooling method.

The capsule diameter, which may be selected as desired, is preferably 0.5 to 100 μm on the average, more preferably, 1 to 20 μm on the average. The shape of capsules can also be selected as desired. For example, it is a spherical shape, the shape of a quadrangular or trigonal pyramid or the shape of a crushed sphere. Capsules 3 may be a rigid body or a soft body.

Another capsule condition is imposed that the capsules are not easily melted or half melted when the recording layer is heated (by high-temperature heating or low-temperature heating). For example, the capsules are made on condition that they are not melted or half melted at 100° C. and 80° C. in the case of the above-described experiment in which the recording layer is put in a high-temperature chamber (at 100° C.), cooled at room temperature to become slightly opaque, put in a low-temperature chamber (at 80° C.) and cooled at room temperature again to become transparent. It is desirable that the capsules are not deformed even when heated by a heating unit such as a thermal head. It is also desirable that each capsule is not easily changed in position relative to the others. These conditions are required to prevent occurrence of irregularities in the surface or dust attached to the heating unit.

It is also presupposed that the capsules 3 is not permeable with any substance. However, in the second embodiment, the capsules 3 may be permeable with some substance.

In the case of the reversible thermal recording medium 6 in accordance with the first embodiment of the present invention shown in FIG. 1A, capsules 3 containing at least organic low-molecular material 4 is applied to support member 2 to form recording layer 1. Capsules 3 may be embedded in a binder (not shown) or the like. As this binder, a thermoplastic resin, a thermosetting resin, an electron beam setting resin or the like may be used. When the reversible thermal recording medium 6 is heated from the recording layer 1 side by an unillustrated heating unit such as a thermal head at a high temperature, the organic low-molecular material 4 in capsules 3 is melted. When the recording medium is thereafter cooled to room temperature, it becomes slightly opaque. When the recording medium is heated by the heating unit at a low temperature, the material in capsules 3 is half melted. When the recording medium is thereafter cooled to room temperature, it becomes transparent. At the time of low-temperature heating, the temperature may be controlled so as to record with a half tone.

Figure 2A:
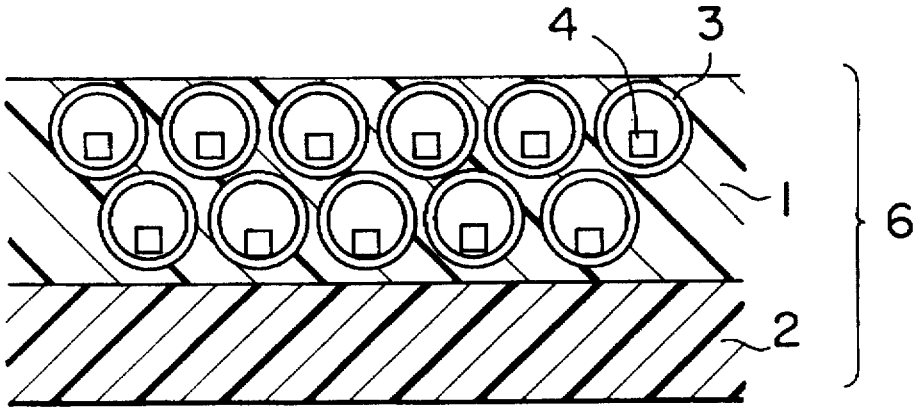
FIGS. 2A and 2B are schematic cross-sectional views of organic low-molecular type reversible recording mediums in accordance with still another embodiment of the present invention.
Figure 2B:
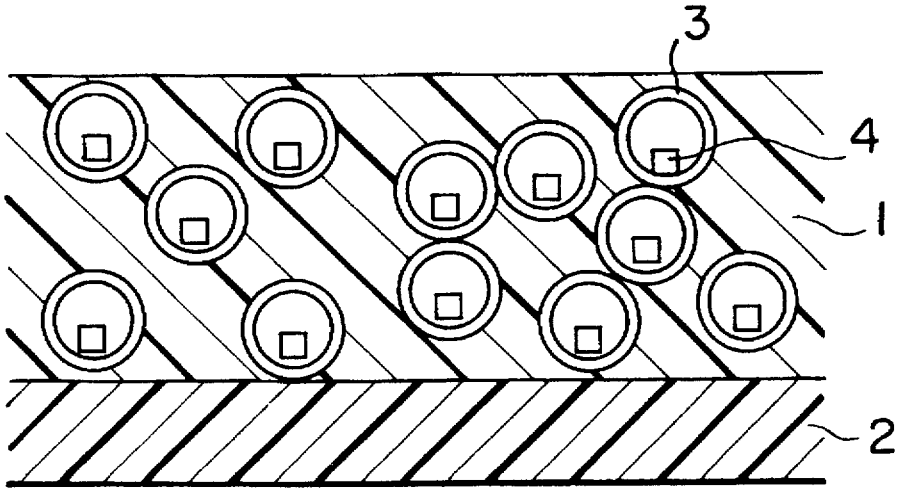

Capsules 3 may contain an additive for an improvement in performance as well as organic low-molecular material 4 which is an indispensable constituent. For example, an ultraviolet absorber, an antioxidant, a sensitizer, an age resister, a light absorber and the like can be added to the encapsulated material. Capsules 3 may be uniformly arranged in two or more layers (rows) as shown in FIG. 2B and may be irregularly formed in two or more layers (rows) as shown in FIG. 2B. An arrangement in which capsule 3 are uniformly dispersed in one or more layers (rows) is more preferable. If it is necessary to obtain a high-contrast image, capsules 3 are arranged in two or more layers (lows). It is also possible to obtain two or more layers of capsules 3 by combining another recording layer 1 having capsules 3.

Figure 3:
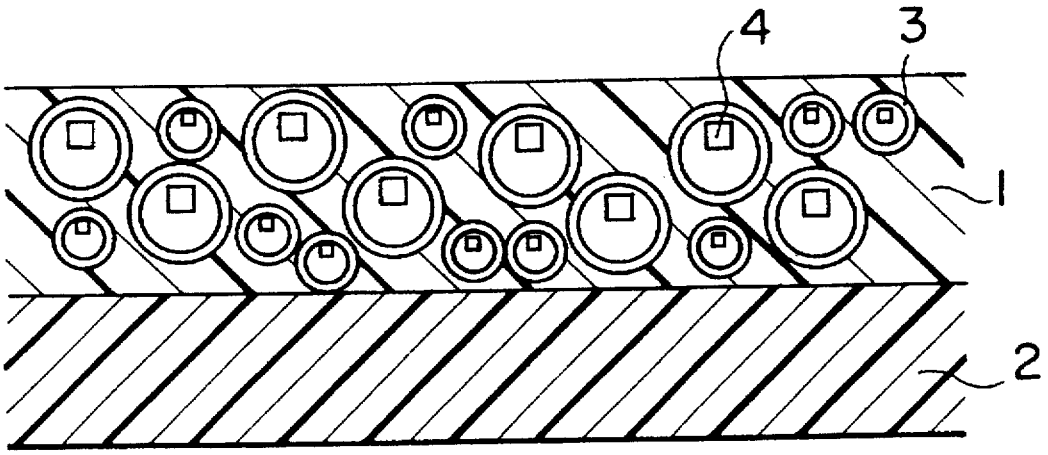
FIG. 3 is a schematic cross-sectional view of an organic low-molecular type reversible recording medium in accordance with a further embodiment of the present invention.

Capsules 3 may be in contact with each other or may be spaced apart from each other. The size of capsules 3 may be varied as shown in FIG. 3, that is, capsules 3 of two or more sizes may be used to reduce the space between capsules 3. In this case, the proportion of the total volume of capsules 3 in the recording layer 1 is increased, so that a high-contrast image can be obtained.

Figure 4:
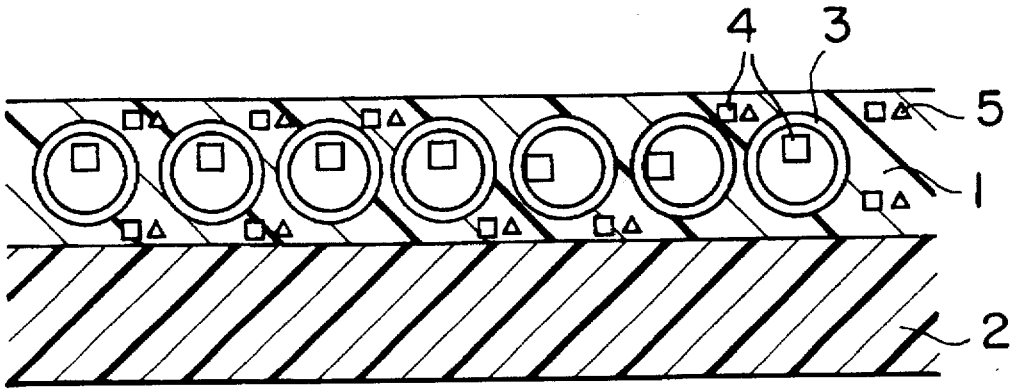
FIG. 4 is a schematic cross-sectional view of an organic low-molecular type reversible recording medium in accordance with still a further embodiment of the present invention.

In the second embodiment, as shown in FIG. 4, at least one constituent of the core material in capsules 3 including organic low-molecular material 4 is put outside and around capsules 3 in recording layer 1. In the arrangement shown in FIG. 4, recording layer 1 is formed of at least organic low-molecular material 4 and capsules 3 (in which the core material includes at least organic mow-molecular material 4.

The advantages of this embodiment reside in that high contrast can be achieved because organic low-molecular material 4 is provided around capsules 3, as well as that the above-described problems of deformation by heat and so on can be solved as in the case of the first embodiment. That is, this effect is due to an increase in the content of organic low-molecular material 4 which is a main constituent for establishing the slightly-opaque state.

In the second embodiment, a resin 5, such as a thermosetting resin, a thermoplastic resin or an ultraviolet setting resin, and the above-mentioned additives may also be provided around capsules 3 to improve the performance. The organic low-molecular material 4 and other materials provided outside capsules 3 may be formed in a layer on the recording layer. To further improve the contrast, support member 2 may be colored, a coloring layer formed of dyestuffs or pigments which are known per se and other materials may be provided under the recording layer, or a colorant may be mixed in the materials inside and outside capsules 3 or in one of these materials in recording layer 1.

Figure 5A:
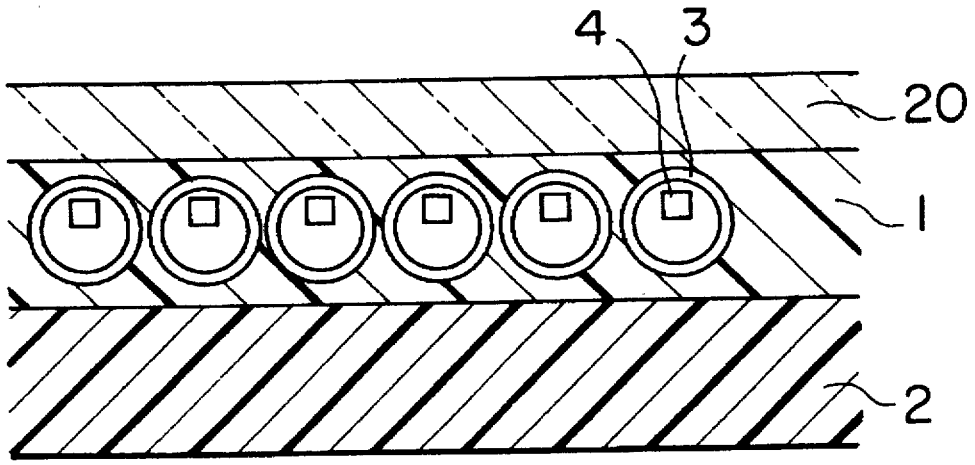
FIGS. 5A and 5B are schematic cross-sectional views of organic low-molecular type reversible recording mediums in accordance with still a further embodiment of the present invention.
Figure 5B:
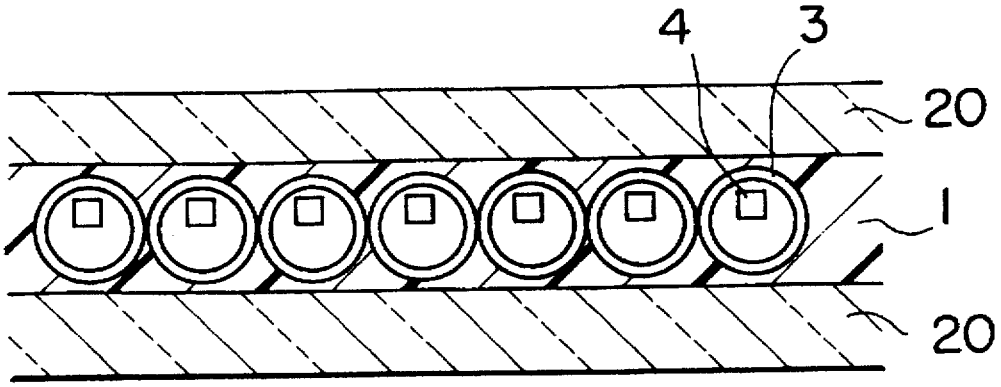

The third embodiment of the present invention will be described below with reference to FIGS. 5A and 5B. FIG. 5A shows a recording medium in which a transparent protective layer 20 is provided on recording layer 1. FIG. 5B shows a recording medium in which a transparent protective layer 20 is provided on each of two surfaces of recording layer 1. The latter having transparent protective layers 20 on both surfaces is effective in a case where recording layer 1 is heated with a heating unit such as a thermal head from the upper side to become opaque and this state is cancelled by heating recording layer 1 from the lower side with a thermal roller or the like. The material of transparent protective layer 20 provided on at least one of the two surfaces of recording layer 1 formed of capsules 3 is selected from high-molecular elastic rubber materials such as silicone rubber or fluorine rubber having rubbery elasticity, inorganic materials, thermoplastic resins including polyester and the like, thermosetting resins, fluorine or silicone resins, ultraviolet or electron beam setting resins and other materials.

The thickness of the transparent protective layer 20 is about 0.1 to 50 μm. Methods for forming these materials as transparent protective layer 20 are, for example, a method of applying the material by casting, spin coating, roll coating, dipping or the like and thereafter causing crosslinking and setting to from a layer, a method of previously forming a protective layer and thereafter fixing recording layer 1 on a surface thereof, and a hard coat method.

The advantages of this embodiment reside in preventing a deterioration in image quality due to the relationship between a recording layer and a protective layer in conventional mediums (a part or the whole of the protective layer separating and attaching to the heating means) and in improving repeat characteristics, which effects will be described below in detail.

It is thought that separation is caused in such a manner that organic low-molecular material 4 in recording layer 1 is melted by heating to reduce the adhesion to transparent protective layer 20, that is, the molten state of organic low-molecular material 4 greatly influences the adhesion to transparent protective layer 20. If the recording layer is selectively heated locally, the protective layer can be partially separated (by partial melting). If the whole recording layer is heated, the whole protective layer can be separated. Irregularities are thereby formed in the medium surface.

In this embodiment of the present invention, recording layer 1 is formed of capsules 3 and transparent protective layer 20 is formed on the recording layer 1 to achieve an improvement in repeat characteristics, to prevent precipitation of organic low-molecular material 4 and to improve the close-contact performance based on reducing the friction coefficient of the surface.

With respect to the improvement in repeat characteristics, recording layer 1 itself is not easily melted since it is constituted of capsules 3, so that the adhesion to transparent protective layer 20 is not deteriorated. In this case, recording layer 1 and transparent protective layer 20 may be bonded to each other by an adhesive which is known per se. The use of both capsules 3 and transparent protective layer 20 contributes to the prevention of precipitation of organic low-molecular material 4. The improvement in close-contact performance or in thermal sensitivity is achieved by the provision of transparent protective layer 20.

Figure 1B:
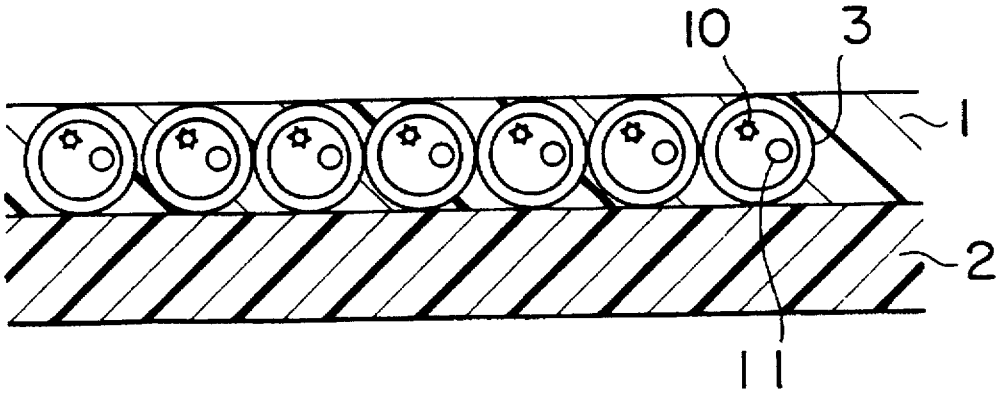
FIG. 1B is a schematic cross-sectional view of a dyestuff type reversible recording medium in accordance with another embodiment of the present invention.

A reversible recording medium in accordance with a further embodiment of the present invention using as a core material a mixture of a lueco dyestuff and a color developing/subtracting agent will be described below. A lueco compound 10 and a color developing/subtracting agent 11 are enclosed in capsules 3, as shown in FIG. 1B. A recording medium having this mixture system can be arranged in the same manner as the above-described mediums having a system using physical changes. Crystal violet lactone or the like is used as lueco compound 10, and a salt of bisacetic acid and a higher fatty acid amine or the like is used as color developing/subtracting agent 11. Needless to say, an inorganic material, a thermoplastic material, a thermosetting resin and the like can be added to the material of recording layer 1 around capsules 3 to improve the performance, and such materials can be enclosed in capsules 3.

Examples of recording mediums to which the present invention is applied will be described below by contrast with conventional mediums shown as comparative examples. "Parts" in the following description denote parts by weight.

EXAMPLE 1

<Preparation of Core Material>

Behenic acid was selected as a core material capable of being reversibly changed in state by heat. (Preparation step)

<Preparation of Microcapsules Containing Behenic Acid>

1.5 g of vinyl chloride-vinyl acetate copolymer (VYHH, a product from UCC) was dissolved in 20 g of methylene chloride, 2.0 g of behenic acid provided as a core material was dispersed. This dispersion material was emulsified (W/O type) in a water solution containing a surfactant. This emulsion was agitated at a high speed while evaporating the liquid to form capsule walls. The material was further processed by filtration, washing with water, decompression and drying to obtain a microcapsule powder containing behenic acid. (Capsule formation step)

<Manufacture of Reversible Recording Medium>

| | |
|---|---|
| Behenic acid containing microcapsule powder | 10 parts |
| Ionomer aqueous dispersion (HYDRAN AP-40, a product from Dainippon Ink and Chemicals, Inc.) | 30 parts |
| Melamine crosslinking agent (DECKAMINE PM-N, a product from Dainippon Ink and Chemicals, Inc.) | 1.5 part |
| Catalyst (CCATALYST ES-2, a product from Dainippon Ink and Chemicals, Inc.) | 0.7 part |

A solution having this composition was applied to a surface of a transparent polyester sheet having a thickness of 188 μm with a wire bar, dried at 100° C. for 3 minutes to effect crosslinking, thereby forming a recording layer having a dried film thickness of 20 μm. An ultraviolet setting resin monomer (ARONIX UV 3700, a product from Toagosei Chemical Industry Co., LTD.) was applied to a surface of the recording layer and was cured by ultraviolet rays to form a 2.5 μm thick protective layer, thus manufacturing a reversible recording medium. (Recording layer formation step)

EXAMPLE 2

<Preparation of Core Material>

Behenic acid was selected as a core material capable of being reversibly changed in state by heat. (Preparation step)

<Preparation of Microcapsules Containing Behenic Acid>

1.0 g of epoxy resin (EPIKOTE 828, a product from Yuka Shell Epoxy K.K.) was heat-dissolved in 30 g of behenic acid at 90° C., and this solution was dropped in 5% gelatin water solution to be emulsified. A liquid prepared by dissolving 3 g of a hardener (EPIKUR U, a product from Yuka Shell Epoxy K.K.) in 20 g of water was gradually dropped in the emulsion. The emulsion was then agitated for about 4 hours while maintaining the liquid temperature at 90° C., so that capsule walls were formed by interfacial polymerization. The material was further processed by filtration, washing with water, and drying to obtain a microcapsule powder containing behenic acid. (Capsule formation step)

<Manufacture of Reversible Recording Medium>

| | |
|---|---|
| Behenic acid containing microcapsules | 10 parts |
| Ultraviolet setting resin (1) trimethylolpropane triacrylate | 10 parts |
| Ultraviolet setting resin (2) silicone diacrylate (EBECRYL 350, a product from Daicel chemical industries, ltd.) | 0.5 part |
| Photopolymerization initiator (DAROCUR 1173, product from Merck) | 0.5 part |

A solution having this composition was applied to a surface of a 188 μm thick polyester sheet on which aluminum was deposited and was cured by ultraviolet rays to form a 15 μm thick recording layer, thus manufacturing a reversible recording medium. (Recording layer formation step)

EXAMPLE 3

<Preparation of Core Material>

A mixture of behenic acid and stearic acid at a ratio of 8:2 was prepared. (Preparation step)

<Preparation of Microcapsules Containing Behenic Acid>

Microcapsules were formed in the same manner as Example 2 except that behenic acid/stearic acid (8/2) was used as a core material. (Capsule formation step)

<Manufacture of Reversible Recording Medium>

A reversible recording medium was manufactured in the same manner as Example 2 except that behenic acid/stearic acid (8/2) was used as a core material. (Recording layer formation step)

EXAMPLE 4

<Preparation of Core Material>

A mixture of a lueco dyestuff and a color developing/subtracting agent at a ratio of 1:2 was prepared. The lueco dyestuff and the color developing/subtracting agent were the following compounds.

(Preparation Step)

Lueco dyestuff: crystal violet lactone

Color developing/subtracting agent:

salt of bisphenolic acetic acid and stearylamine

<Preparation of Microcapsules>

Microcapsules were formed in the same manner as Example 2 except that lueco dyestuff/color developing/subtracting agent (½) was used as a core material. (Capsule formation step)

<Manufacture of Reversible Recording Medium>

| | |
|---|---|
| Lueco dyestuff/color developing/subtracting agent containing microcapsules | 10 parts |

-continued

| | |
|---|---|
| Calcium carbide | 10 parts |
| Zinc stearate | 2 parts |
| Polyester resin (Tg: 100° C.) (KEMIT K588, a product from Toray Industries, Inc.) | 5 parts |
| Curing agent (CORONATE EH, a product from Nippon Polyurethane Industry Co., Ltd.) | 0.25 parts |
| Catalyst (dibutyltindiacetate) | 0.02 part |
| Toluene | 30 parts |

A solution having this composition was applied to a surface of a white polyester sheet having a thickness of 188 μm with a wire bar, and was dried and cured to form a recording layer having a dried film thickness of 20 μm. An ultraviolet setting resin monomer (ARONIX UV 3700, a product from Toagosei Chemical Industry Co., LTD.) was applied to a surface of the recording layer and was cured by ultraviolet rays to form a 2.0 μm thick protective layer, thus manufacturing a reversible recording medium. (Recording layer formation step)

Comparative Example 1

A reversible recording medium was manufactured in the same manner as Example 2 except that no microcapsules were used. This medium was provided as a sample to be compared with Example 2.

Comparative Example 2

A reversible recording medium was manufactured in the same manner as Example 4 except that no microcapsules were used. This medium was provided as a sample to be compared with Example 4.

The following table shows the results of tests of Examples 1 to 4 and Comparative Examples 1 and 2. As can be understood from this table, Examples 1, 2, 3, and 4 to which the present invention was applied were superior than Comparative Examples of Conventional mediums.

TABLE

| | Recording Method | Repeat-ability | Image quality | Sensitivity |
|---|---|---|---|---|
| Example 1 | Organic low-molecular type | ○ | ○ | ○ |
| Example 2 | Organic low-molecular type | ○ | ○ | ○ |
| Example 3 | Organic low-molecular type | ○ | ○ | ○ |
| Example 4 | Lueco dyestuff type | ○ | ○ | ○ |
| Comparative example 1 | Organic low-molecular type | X | X | ○ |
| Comparative example 2 | Lueco dyestuff type | X | X | |

○: Good X: Defective

With respect to the embodiments of the present invention, a reversible thermal recording medium has been described which is capable of repeating recording and erasing by heat, and which is characterized by having a recording layer including capsules in which a core material constituted of at least an organic low-molecular material or constituted of at least a lueco compound and a color developing/subtracting agent capable of developing or subtracting a color by thermally reacting with the lueco compound is enclosed.

Another reversible thermal recording medium has been described which is capable of repeating recording and erasing by heat, and which is characterized by having a recording layer including capsules in which a core material constituted of at least an organic low-molecular material or constituted of at least a lueco compound and a color developing/subtracting agent capable of developing or subtracting a color by thermally reacting with the lueco compound is enclosed, the same material as at least one of constituents of the core material being provided at least around the capsules.

A further reversible thermal recording medium has been described which is capable of repeating recording and erasing by heat, and which is characterized by having a transparent protective layer on one or both surfaces of a recording layer including capsules.

Further specific reversible recording mediums: one in which capsules in a recording layer have two or more sizes; one in which two or more layers of capsules are formed in a recording layer; and one in which the walls of capsules in a recording layer are not permeable with any substance have also been described.

The present invention is not limited to the above-described embodiments and can be changed variously according to need. The features of the present invention reside in, in a reversible thermal recording medium capable of repeating recording/erasing by heat, enclosing a core material in capsules, disposing the same material as the core material around the capsules, and providing a transparent protective layer on one or both surfaces of the recording layer having capsules, and various changes and modifications can be made with respect to the manufacturing method and addition of materials.

The embodiment have been described with respect to reversible recording mediums of an organic low-molecular type and an lueco dyestuff type. However, needless to say, the present invention can be applied to a high polymer blending type, a crystalline high polymer type utilizing phase change, a high polymer liquid crystal type utilizing phase transition, a thermochromic type, and the like.

According to the present invention, as described above, the problem of a deterioration in image quality caused by transfer of a part of the recording layer to the heating unit is solved and the repeat characteristics are remarkably improved, so that the running cost can be reduced.

A high-contrast image can be obtained by the effect of the provision of the core material around the capsules.

What is claimed is:

1. A reversible thermal recording medium comprising:

a substrate; and a first recording layer on the substrate and a second recording layer on the first recording layer, each layer including a binder and, in the binder, a plurality of capsules, each of said capsules containing a core material comprising a resin admixed with an organic low-molecular weight material capable of interacting with the resin so as to render the core material opaque upon being heated from a first temperature to a second, elevated temperature followed by cooling to said first temperature, and transparent upon being heated from said first temperature to a third, elevated temperature followed by cooling to said first temperature, said first and second recording layers being capable of undergoing repeated recording and erasing of visible states by heat through reversible visible physical change.

2. A reversible thermal recording medium according to claim 1 wherein at least one of said first and second recording layers comprising a plurality of capsules of two or more sizes.

3. A reversible thermal recording medium according to claim 1 wherein said binder comprises a resin selected from the group consisting of a thermosetting resin, a thermoplastic resin, and an ultraviolet setting resin.

4. A reversible thermal recording medium according to claim 1, further comprising a protective layer on at least one surface of said reversible thermal recording medium.

5. A method for reversibly recording data on a recording layer comprising:

providing a substrate and, on the substrate, a recording layer comprising a binder and, in the binder, a plurality of capsules containing a core material comprising a resin admixed with an organic low-molecular weight material capable of interacting with the resin so as to render the core material opaque upon being heated from a first temperature to a second, elevated temperature followed by cooling to said first temperature, and transparent upon being heated from said first temperature to a third, elevated temperature followed by cooling to said first temperature, heating said recording layer from a first temperature to a second, elevated temperature and cooling said recording layer to said first temperature to change said recording layer from a transparent state to an opaque state, and heating said recording layer from said first temperature to a third, elevated temperature and cooling said recording layer to said first temperature to change said recording layer from said opaque state to said transparent state.

6. The method as recited in claim 5, wherein said second, elevated temperature is higher than said third, elevated temperature.

7. The method as recited in claim 6, wherein said first temperature is about 20° C., said second, elevated temperature is about 100° C. and said third, elevated temperature is about 80° C.

8. The method as recited in claim 5, wherein said providing step comprises:

selecting an organic low-molecular weight material that forms polycrystals when heated from said first temperature to said second, elevated temperature and then cooled to said first temperature, and which forms a monocrystal when heated from said first temperature to said third, elevated temperature and then cooled to said first temperature, providing a plurality of capsules containing said organic low-molecular weight material, and providing said capsules in said binder on said substrate.

9. The method as recited in claim 5, wherein said organic low-molecular weight material is selected from the group consisting of higher fatty acids and higher fatty acid esters.

10. The method as recited in claim 5, wherein said organic low-molecular weight material is selected from the group consisting of stearic acid, arechic acid, behenic acid, and esters of these acids.

11. The method as recited in claim 5, wherein said recording layer further comprises said organic low-molecular weight material provided outside of said plurality of capsules in said binder.

* * * * *